US006626729B2

(12) United States Patent
Osawa

(10) Patent No.: US 6,626,729 B2
(45) Date of Patent: Sep. 30, 2003

(54) TOY TOPS

(75) Inventor: Takashi Osawa, Tokyo (JP)

(73) Assignee: Takara Co., Ltd., Tokyo (JP)

( * ) Notice: Subject to any disclaimer, the term of this patent is extended or adjusted under 35 U.S.C. 154(b) by 20 days.

(21) Appl. No.: 09/927,810

(22) Filed: Aug. 9, 2001

(65) Prior Publication Data

US 2002/0102907 A1 Aug. 1, 2002

(51) Int. Cl.[7] ..... A63H 1/00
(52) U.S. Cl. ..... 446/250
(58) Field of Search ..... 446/263, 256, 446/264, 259, 262, 260, 266, 257, 108, 236; 273/147; 473/588, 589; D21/460–464

(56) References Cited

U.S. PATENT DOCUMENTS

| | | | | |
|---|---|---|---|---|
| 215,458 A | * | 5/1879 | Jones | |
| 1,260,717 A | * | 3/1918 | Schmidt | |
| 3,936,974 A | | 2/1976 | House | |
| 4,954,116 A | * | 9/1990 | Rubino | 446/256 |
| 5,017,172 A | * | 5/1991 | Seifert | 446/250 |
| 5,951,353 A | * | 9/1999 | Moore | 446/46 |

FOREIGN PATENT DOCUMENTS

| | | |
|---|---|---|
| DE | 68 784 C | 6/1893 |
| DE | 4 35 645 | 10/1926 |
| DE | 19908679 | 8/2000 |
| JP | 7163759 | 6/1996 |
| JP | 9155067 | 6/1997 |
| JP | 11114232 | 4/1999 |

* cited by examiner

*Primary Examiner*—Derris H. Banks
*Assistant Examiner*—Jamila Williams

(57) ABSTRACT

A toy top comprising a toy body having a revolving shaft arranged at a lowermost portion of the toy body and a mount support member provided therein; the toy body including a plurality of blade members; the blade members being laid to overlap each other; and the blade members being detachably mounted with respect to the remaining blade members through the mount support member. A revolving shaft control mechanism is provided in the toy body so as to control revolution of the revolving shaft.

14 Claims, 8 Drawing Sheets

TOY TOPS

BACKGROUND OF THE INVENTION

This invention relates to a toy top, and more particularly to a toy top having a revolving shaft made of a flexible material.

A toy top has been commonly used for a game or play by children. For example, children compete with their companions in toy top. More specifically, children often play a game of striking their toy tops against those of their companions or competitors to beat the competitors' toy tops. Also, they often play another game of driving out toy tops of their companions from a game space (game board) by means of their own toy tops.

In order to permit children to further enjoy such plays or games as described above, a variety of toy tops have been proposed and put in practice in the art. Thus, the toy tops proposed are typically directed to an improvement in revolution thereof such as an increase in stability of revolution thereof, an increase in revolving speed thereof or the like.

Unfortunately, the prior art fails to provide a toy top which can be disassembled so that replacement of parts thereof may be carried out to vary revolving characteristics thereof, to thereby tune up the toy top for an intended game. In addition, the prior art fails to provide a toy top exhibiting revolving characteristics such as, for example, those which permit a toy top to initially revolve while moving about in all directions and then stably revolve at a fixed spot or position.

SUMMARY OF THE INVENTION

The present invention has been made in view of the foregoing disadvantage of the prior art.

Accordingly, it is an object of the present invention to provide a toy top which can be disassembled so that replacement of parts thereof may be carried out to vary revolving characteristics thereof, to thereby tune up the toy top for an intended game.

It is another object of the present invention to provide a toy top which is capable of controlling revolution thereof about a revolving shaft thereof to vary revolving characteristics depending on a variation in revolving speed thereof.

In accordance with the present invention, a toy top is provided. The toy top includes a toy body, which is constituted by a plurality of blade members being laid to overlap each other. The blade members each can be selected from a group consisting of a plurality of blade members replaceable with each other. The toy body is provided with a common mount means through which each of the blade members is permitted to be detachably mounted with respect to the remaining blade members. The toy top includes a revolving shaft arranged at a lowermost portion of the toy body.

In a preferred embodiment of the present invention, the toy top further includes a revolving shaft control mechanism provided in the toy body so as to control revolution of the revolving shaft.

In a preferred embodiment of the present invention, the revolving shaft control mechanism is constituted by press members arranged on a side surface of the revolving shaft so as to be opposite to each other. The press members are arranged in a manner to be movable in a direction perpendicular to the revolving shaft and constantly elastically urged in a direction apart from the revolving shaft, resulting in centrifugal force due to revolution of the toy top forcing the side surface of the revolving shaft against elastic urging of the pressing members.

In a preferred embodiment of the present invention, the revolving shaft has a lower end flatly formed.

In a preferred embodiment of the present invention, the revolving shaft control mechanism is arranged on a lowermost blade member of the blade members.

In a preferred embodiment of the present invention, at least one of the blade members is constituted by a weight member.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, a toy top according to the present invention will be described with reference to the accompanying drawings.

Figure 1:
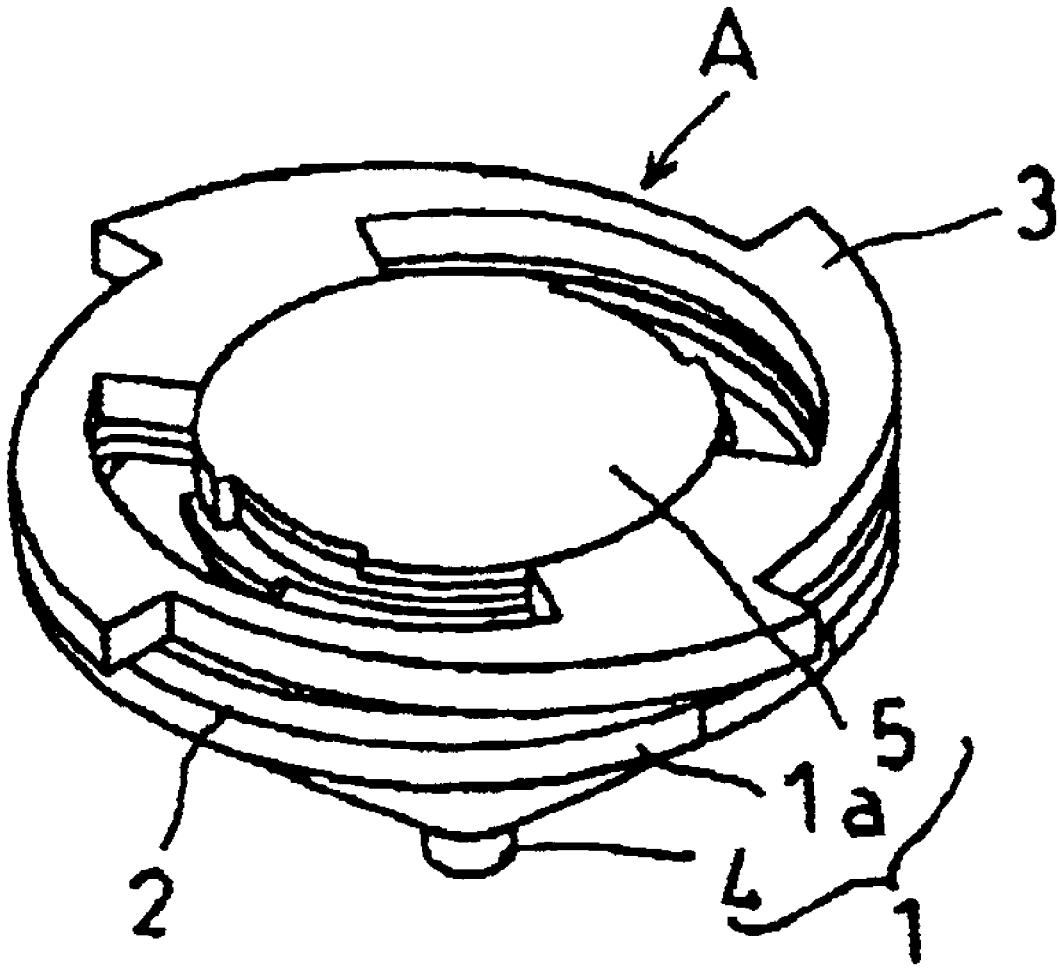
FIG. 1 is a perspective view showing an embodiment of a toy top according to the present invention.

Referring first to FIG. 1, an embodiment of a toy top according to the present invention is illustrated. A toy top of the illustrated embodiment generally designated at reference character A generally includes a toy body constructed in a overlapped manner and a revolving shaft 4. The toy body includes a base blade member 1 constituting a lowermost blade member of the toy top, an intermediate blade member 2 arranged on the base blade member 1, and an upper blade member 3 arranged on the intermediate blade member 2.

Figure 2:
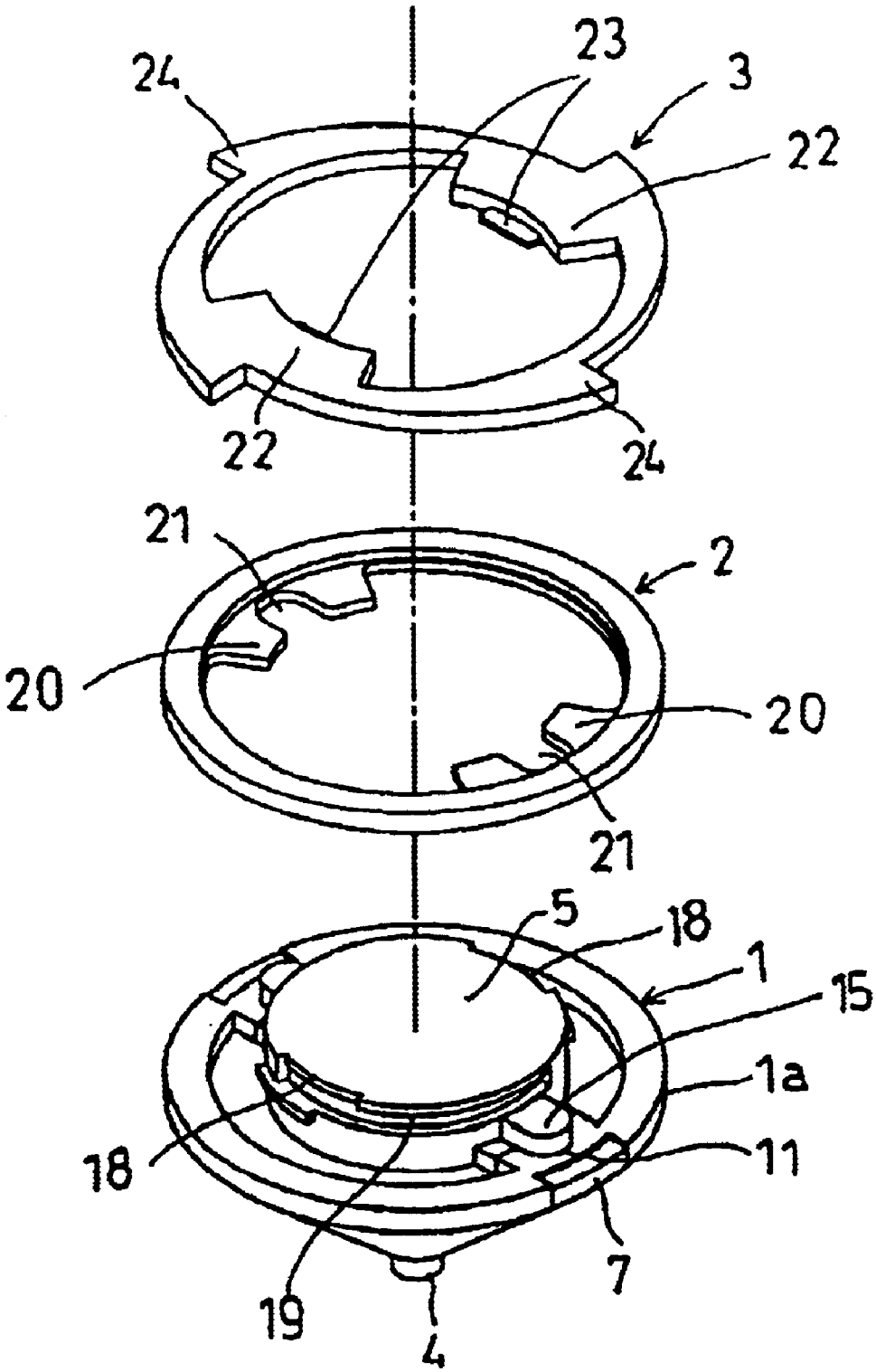
FIG. 2 is an exploded perspective view of the toy top shown in FIG. 1.
Figure 3:
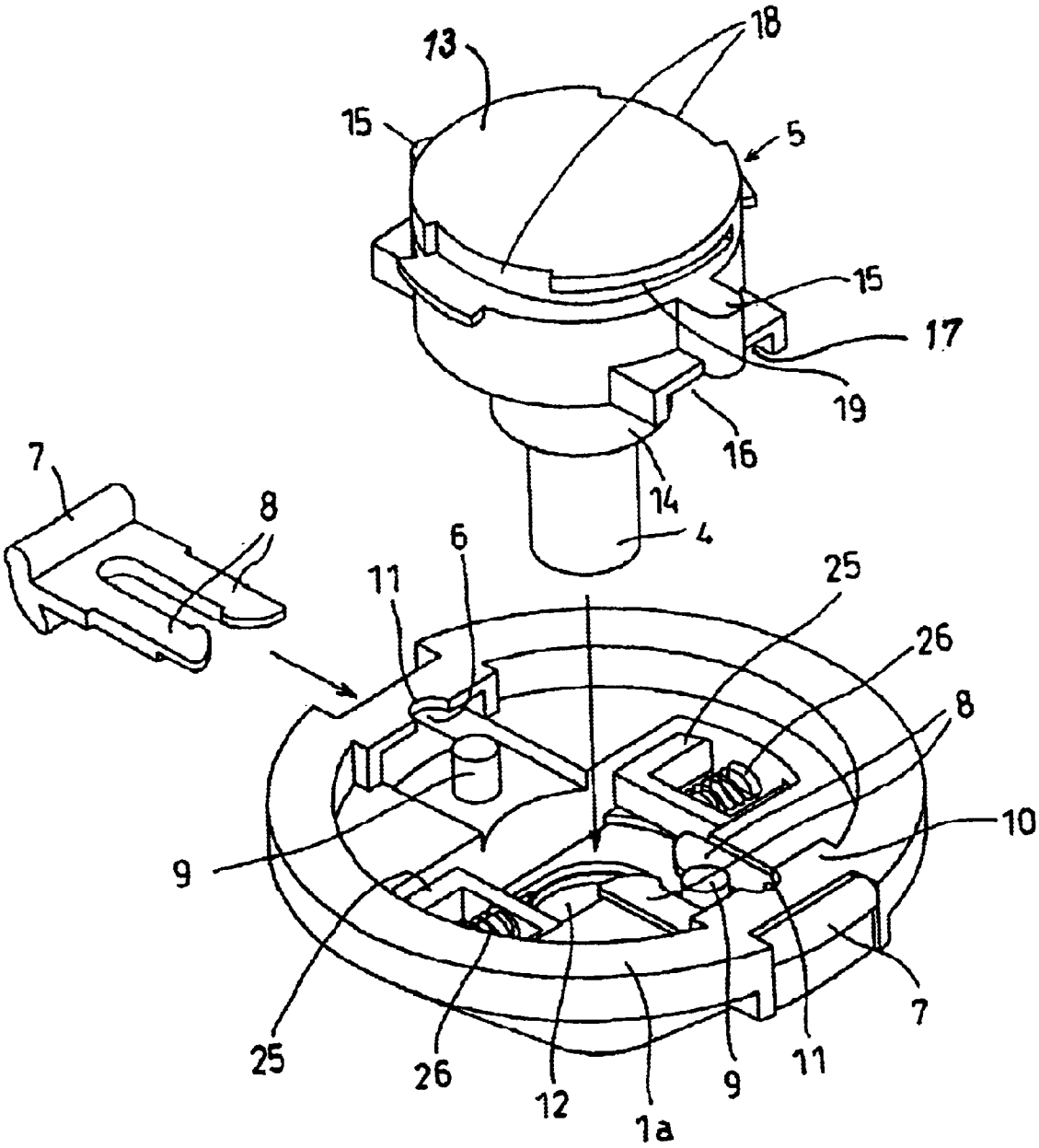
FIG. 3 is an exploded perspective view showing a lower blade member incorporated in the toy top shown in FIG. 1.

The base blade member 1, as shown in FIGS. 2 and 3, is constituted by a base blade member body 1*a* having a lower surface formed into an inverted conical shape and a mount support 5 on which the intermediate blade member 2 and upper blade member 3 are mounted.

The base blade member body 1*a* is formed on a side surface of an upper portion thereof with a pair of openings 6 in a manner to be opposite to each other and so as to be laterally open. The openings 6 each have a holder or stopper 7 detachably mounted therein. The stoppers 7 each are formed with a pair of legs 8. Reference numeral 9 designates projections each of which is interposedly arranged between the legs 8 of each of the stoppers 7. The openings 6 are provided on an upper element 10 of the base blade member body 1*a*, which is formed with recesses 11. The base blade member body 1*a* is formed at a central portion thereof with a central hole 12.

The mount support 5 includes a head section 13 of a flat cylindrical shape and a press section 14 reduced in diameter and mounted under the head section 13. Also, the mount support 5 is provided on a side surface thereof with projections 15 in a manner to be opposite to each other. The projections 15 each are formed at a lower portion thereof with a fit-in groove 16 in which each of the stoppers 7 is fitted. The fit-in grooves 16 each are formed so as to extend at a distal end thereof to a recess 17 (FIG. 5) formed at the press section 14. In addition, the head section 13 is formed at an upper portion thereof with a pair of cutouts 18 in a manner to be opposite to each other. The cutouts 18 each are formed on a peripheral surface of a lower portion thereof with a mount groove 19 in such a manner that the groove 19 of each of the cutouts 18 extends at a distal end thereof to a position in proximity to the other cutout 18.

Figure 4:
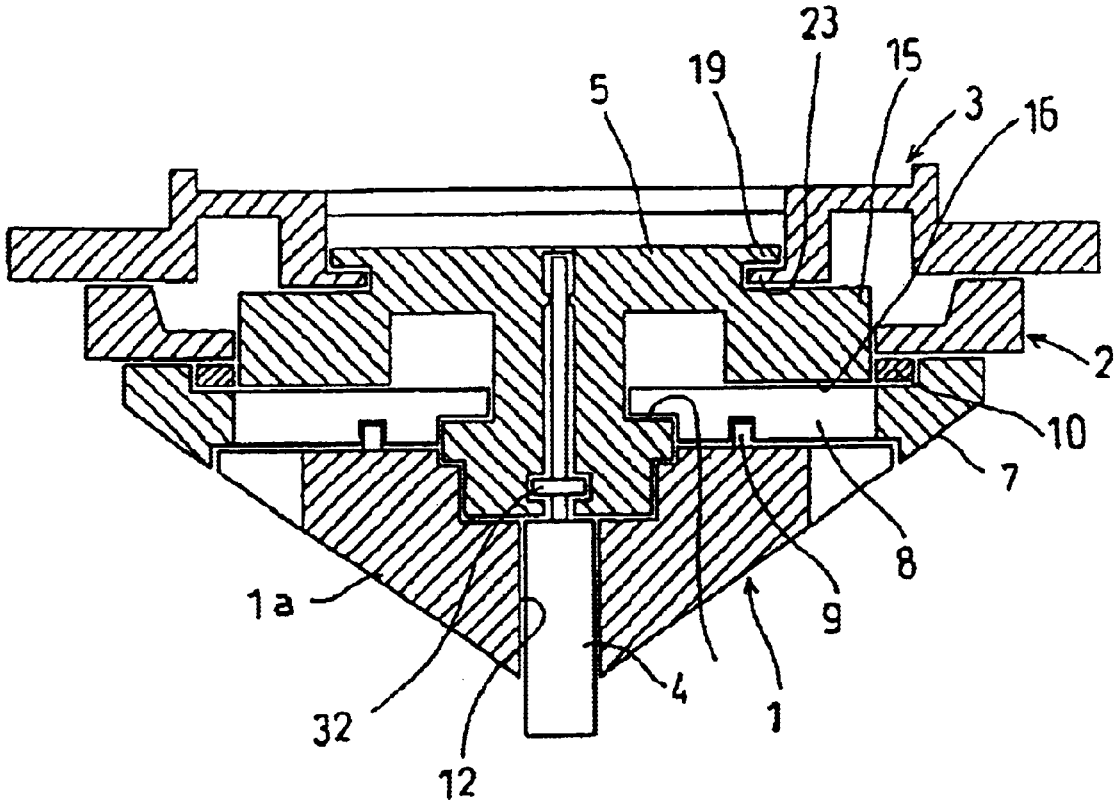
FIG. 4 is a vertical sectional view of the toy top shown in FIG. 1.

The mount support 5, as shown in FIG. 4, has the projections 15 engagedly fitted in the recesses 11 of the base member 1 and the press section 14 fitted in the central hole 12 of the base blade member 1. Then, the stoppers 7 are inserted through the openings 6 of the base blade member 1 into the fit-in grooves 16 of the mount support 5. Fixing of the mount support 5 on the base blade member 1 is carried out by inserting the legs 8 of the stoppers 7 into the recesses 17 of the mount support 5 to engage both with each other. At this time, the press section 14 functions to prevent the revolving shaft 4 from being detached from the central hole 12 of the base blade member 1.

The revolving shaft 4 is rotatably mounted on the mount support 5 and arranged so as to extend through the central hole 12 of the base blade member body 1*a*. Reference numeral 32 designates a bearing for the revolving shaft 4.

The toy top of the illustrated embodiment further includes a revolving shaft control mechanism for controlling revolution of the revolving shaft 4. The revolving shaft control mechanism is arranged on a line defined so as to extend through a center of the base blade member body 1*a* and extend in a manner to be perpendicular to a line defined by connecting the openings 6 of the base blade member 1 to each other.

Figure 5:
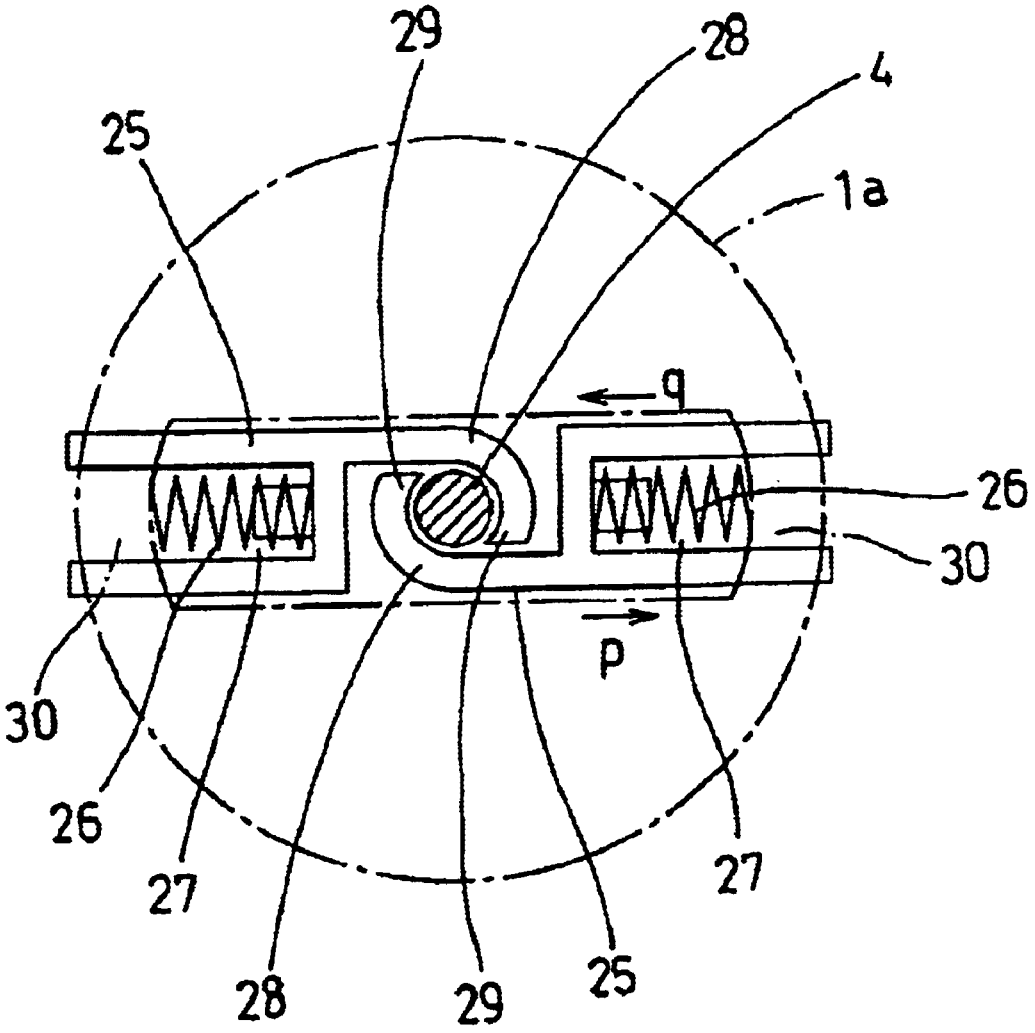
FIG. 5 is a plan view showing an essential part of a base blade member incorporated in the toy top shown in FIG. 1.

The revolving shaft control mechanism, as shown in FIGS. 3 and 5, is constituted by a pair of press members 25 which is made of metal, arranged on a side surface of the revolving shaft 4 so as to be opposite to each other and elastically urged in a direction perpendicular to the revolving shaft 4 so as to constantly press the side surface of the revolving shaft 4. More specifically, the press members 25 each are arranged in the base blade member body 1*a* so as to be slidable in a radial direction thereof. The press members 25 each are formed on an outer side thereof with a receiving section 27 in which a spring 26 is received and on an inner side thereof with an extension 28. The extensions 28 each are formed at a distal end thereof with a press portion 29. In the illustrated embodiment, the press portions 29 each are bent in a manner to partially surround the revolving shaft 4, so that the press portions 29 of the extensions 28 of the press members 25 may cooperate with each other to substantially surround the revolving shaft 4. The springs 26 each are engaged with an edge 30 of the base blade member body 1*a* and an inner end of the spring receiving section 27, to thereby constantly urge each of the press portions 29 in a direction apart from the revolving shaft 4.

The intermediate blade member 2, as shown in FIG. 2, is formed into a disc-like shape and provided at a central portion thereof with an opening. Alternatively, the intermediate blade member 2 may be formed into a polygonal shape. The intermediate blade member 2 is formed on an inner peripheral edge thereof with a pair of protrusions 20 in a manner to be opposite to each other. The protrusions 20 each are formed at a central portion thereof with a groove 21 for engagement. In the illustrated embodiment, the intermediate blade member 2 is preferably increased in weight as compared with the other members, resulting in acting as a weight member. The intermediate blade member 2 is preferably made of a metal material.

The upper blade member 3 is likewise formed into a disc-like shape and provided at a central portion thereof with an opening. The upper blade member 3 is made of a synthetic resin material and formed on an inner peripheral edge thereof with a pair of protrusions 22 in a manner to be opposite to each other. The protrusions 22 each have an inner edge configured into a curved or arcuate shape and formed into a size which permits it to be fitted on the mount support 5. The protrusions 22 each are formed on a central portion of the inner edge thereof with a holding element 23 in a manner to project therefrom. The holding elements 23 are so formed that an interval or distance therebetween is substantially equal to a distance between the cutouts 18 of the mount support 5. Also, the upper blade member 3 is provided on an outer peripheral edge thereof with a plurality of operation elements 24, each of which may be formed into any suitable shape. Further, the upper blade member 3 is formed into a maximum diameter larger than that of each of the base blade member 1 and intermediate blade member 2. The upper blade member 3 may have a suitable character display applied thereto.

Now, the manner of assembling the toy top of the illustrated embodiment thus constructed will be described.

Figure 6:
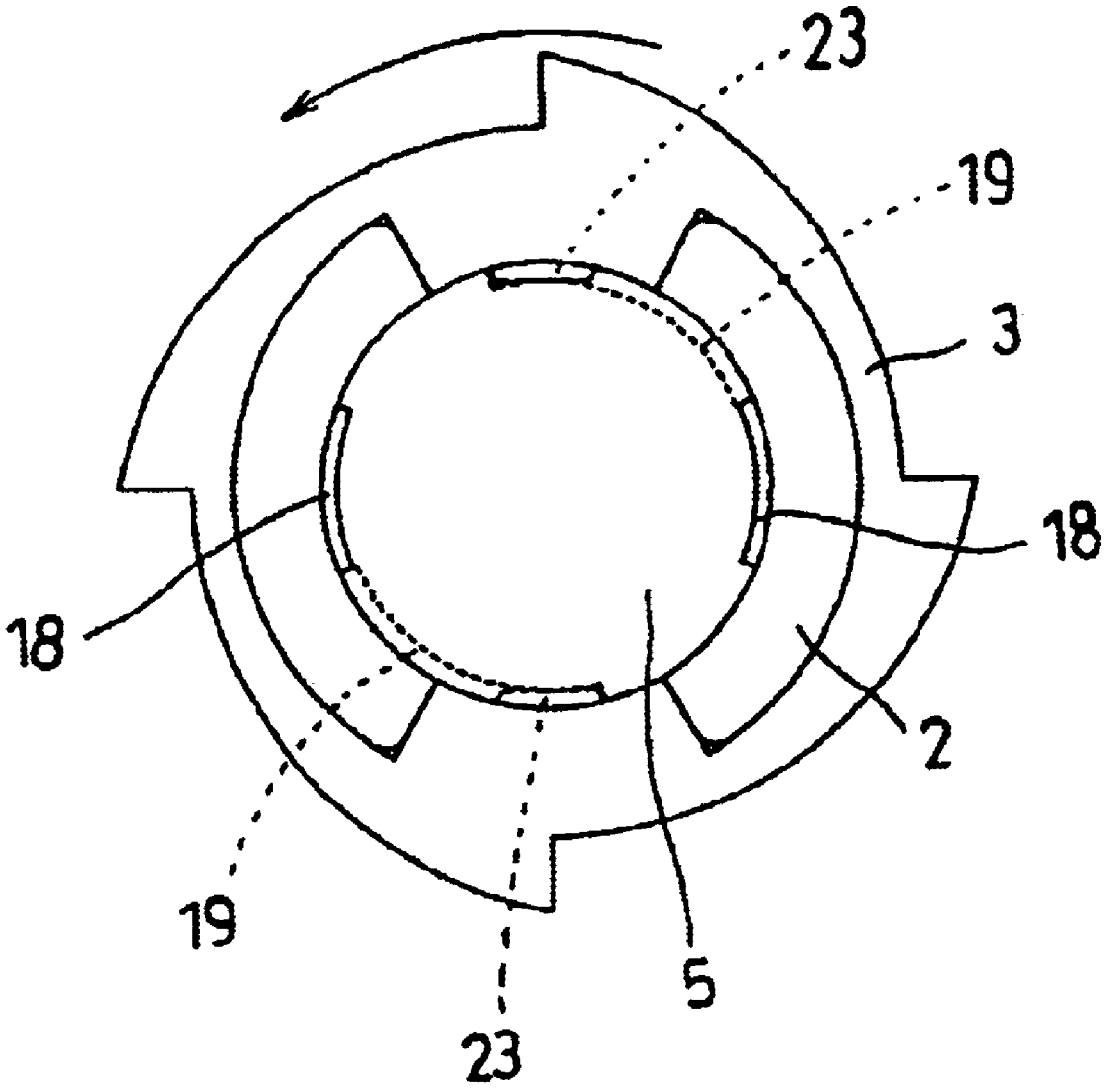
FIG. 6 is a plan view showing an upper blade member incorporated in the toy top, which is rotated by about 90 degrees.

First of all, the intermediate blade member 2 is placed or superposed on the base blade member 1 to attain engagement between the projections 15 of the mount support 5 and the engagement grooves 21 of the protrusions 20 of the intermediate blade member 2. Then, as shown in FIG. 4, the upper blade member 3 is superposed on the intermediate blade member 2 and both are positioned with respect to each other so as to align the holding elements 23 of the upper blade member 3 with the cutouts 18 of the mount support 5 of the base blade member 1, followed by downward pushing of the upper blade member 3 into the intermediate blade member 2. This permits the protrusions 22 of the upper blade member 3 to be supported on the projections 9 of the mount support 5 of the base blade member 1 and permits the holding elements 23 of the protrusions 22 of the upper blade member 3 to be aligned with the mount grooves 19 of the mount support 5 of the base blade member 1. Then, as shown in FIG. 6, the upper blade member 3 is rotated relatively to the base blade member 1 to slide each of the holding elements 23 of the upper blade member 3 to the distal end of each of the mount grooves 19 along the mount groove in a counter-clockwise direction, resulting in the upper blade member 3 being fitted on the base blade member 1. Such fitting of the upper blade member 3 on the base blade member 1 permits the intermediate blade member 2 to be pressedly fixed on the base blade member 1, resulting in providing the toy top A wherein the intermediate blade member 2 and upper blade member 3 are arranged on the base blade member 1 in a manner to be superposed or overlapped thereon.

Disassembling of the toy top is carried out by rotating the upper blade member 3 in an opposite or clockwise direction to align the holding elements 23 of the protrusions 22 of the upper blade member 3 with the cutouts 18 of the mount support 5 of the base blade member 1, followed by upward detachment of the upper blade member 3 from base blade member 1. Then, the intermediate blade member 2 is likewise upwardly released from the base blade member 1.

Revolution of the toy top of the illustrated embodiment may be carried out by means of either a string or a shooter known in the art.

The toy top A of the illustrated embodiment constructed as described above may be enjoyed in various ways. For example, it may be played either by revolution as in the conventional toy top or in a manner to strike the upper blade members of two or more such toy tops against each other during revolution on a game board.

Figure 7A:
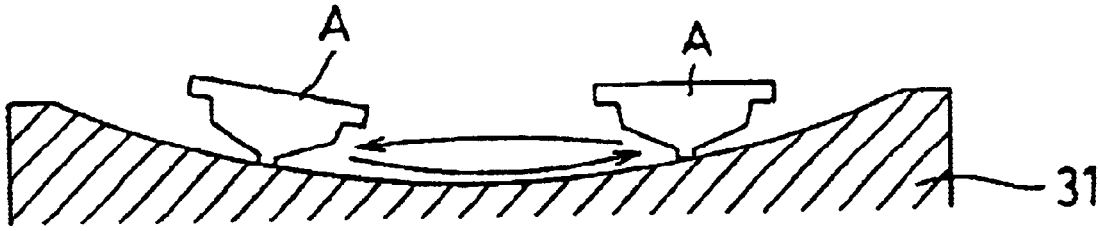
FIGS. 7A and 7B each are a schematic view showing the manner of playing of the toy top shown in FIG. 1.

In an embodiment, the toy top is increased in revolving speed at an initial stage of the revolution, to thereby exert centrifugal force on each of the press members 25, so that it may be moved as indicated at an arrow p in FIG. 5 against elastic force of each of the springs 26. This permits each of the press member 25 to force the revolving shaft 4, resulting in the revolving shaft 4 being rotated with the toy body. In the illustrated embodiment, the revolving shaft 4, as described above, has the lower end formed to be flat. Thus, revolution of the toy top on a game board 31 formed into a concave shape permits a position on the game board at which the revolving shaft 4 is contacted with the game board to be substantially varied with time. This causes gravity of the toy top to be varied correspondingly, so that the toy top may revolve while shifting in all directions as shown in FIG. 7A.

Figure 7B:
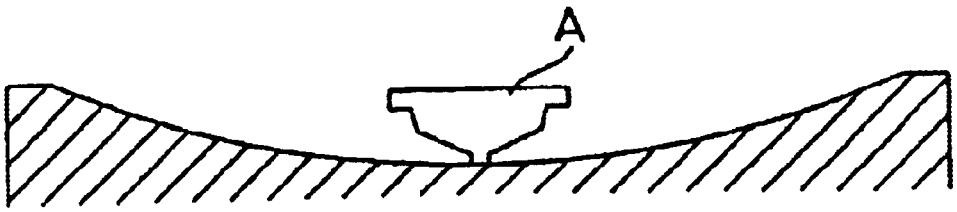

Then, when the revolving shaft 4 is reduced in revolving speed with time, elastic force of the spring 26 of each of the press members 25 overcomes the centrifugal force, so that the press member 25 may be moved in such a direction as indicated at an arrow q in FIG. 5. This permits the revolving shaft 4 to be released from each of the press members 25, so that the revolving shaft 4 may be rendered independent from the toy body. This means that the toy top is kept revolving and the revolving shaft 4 is kept from revolving, during which a position at which the toy top is contacted with the game board 31 is kept from being varied. Thus, a position of gravity of the toy top is kept fixed, so that the top body may revolve at a fixed position as shown in FIG. 7B.

When the intermediate blade member 2 is constructed so as to act as a weight member, it is increased in weight, so that the toy top may be increased in both stability and shock resistance.

The toy top of the illustrated embodiment is not limited to such a three-layer structure as described above. It may be constructed into a two-layer or four- or more-layer structure.

Also, the illustrated embodiment may be configured in such a manner that a plurality of the base blade members 1, a plurality of the intermediate blade members 2 and a plurality of the upper blade members 3 are prepared so as to permit the base blade member 1, intermediate blade member 2 and upper blade member 3 to be selectively combined with each other as desired. Also, the illustrated embodiment may be constructed so that the blade members 1, 2 and 3 each are provided with a common mount means which permits the blade members to be connected to each other in a detachable manner therethrough.

Figure 8A:
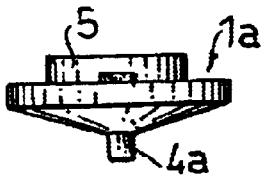
FIGS. 8A to 8C each are a plan view showing a base blade member by way of example.
Figure 8B:
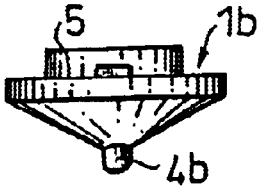
Figure 8C:
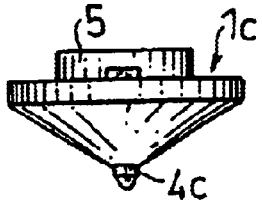

More specifically, the base blade member 1 may be selected from a group consisting of base blade member elements 1*a*, 1*b* and 1*c* shown in FIGS. 8A to 8C. More particularly, the base blade member element 1*a* of FIG. 8A is so configured that a height thereof is reduced and a revolving shaft 4*a* has a distal end increased in area. The base blade member element 1*b* of FIG. 8B is so constructed that a height thereof is intermediate and a distal end 4*b* thereof has an intermediate area. In the base blade member element 1*c* of FIG. 8C, a height thereof is increased and a revolving shaft 4*c* is somewhat pointed at a distal end thereof. The base blade member element 1*a* of FIG. 8A is increased in stability because of being reduced in height. Also, it is varied in a position at which the revolving shaft 4*a* is contacted with a floor or the ground even when it is slightly inclined, resulting in readily moving in all directions. The base blade member element 1*c* of FIG. 8C is reduced in stability because the height is increased. However, it tends to revolve at the same position since the revolving shaft 4*c* is pointed at the distal end thereof. The base blade member element 1*b* shown in FIG. 8B exhibits intermediate characteristics between those of the base blade member element 1*a* and those of the base blade member element 1*c*.

Figure 9A:
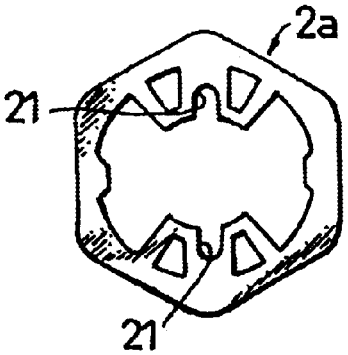
FIGS. 9A to 9C each are a plan view showing an intermediate blade member by way of example.
Figure 9B:
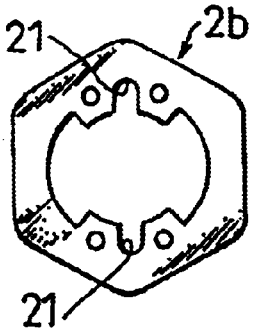
Figure 9C:
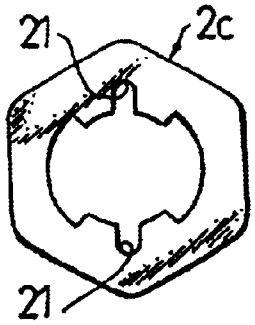

The intermediate blade member 2 likewise may be selected from a group consisting of intermediate blade member elements 2*a*, 2*b* and 2*c* shown in FIGS. 9A to 9C. The element 2*a* shown in FIG. 9A is increased in outer diameter and reduced in weight. The element 2*b* of FIG. 9B is configured into an intermediate outer diameter and an intermediate weight. The element 2*c* of FIG. 9C is reduced in outer diameter and increased in both thickness and weight. An increase in outer diameter of the intermediate blade member 2 permits an increase in centrifugal force of the member, leading to revolution of the member over a long period of time. An increase in weight of the intermediate blade member permits it to be enhanced in stability and impact resistance. The intermediate blade member 2 significantly affects revolving characteristics of the toy top.

Figure 10A:
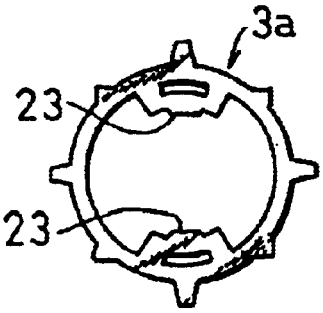
FIGS. 10A to 10C each are a plan view showing an upper blade member by way of example.
Figure 10B:
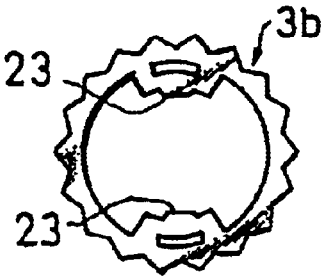
Figure 10C:
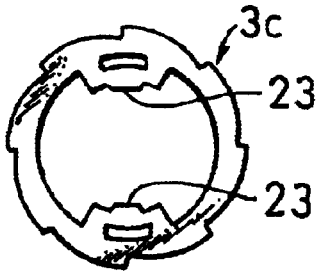

The upper blade member 3 is arranged in such a manner that an outer peripheral end thereof is outwardly projected from the base blade member 1 and intermediate blade member 2 when the toy top is assembled. Thus, a variation in configuration of an outer peripheral edge of the upper blade member 3 permits the toy top to exhibit a variety of attack patterns because the toy top exhibits different attacking power depending on the configuration when the upper blade member 3 is struck against that of a competitor's toy top. For example, the upper blade member 3 may be selected from a group consisting of upper blade member elements 3*a*, 3*b* and 3*c* shown in FIGS. 10A to 10C.

Also, the base blade member elements 1*a* to 1*c*, intermediate blade member elements 2*a* to 2*c* and upper blade member elements 3*a* to 3*c* are provided with common mount means, respectively. More specifically, the base blade member elements 1*a* to 1*c* each are provided with the mount support 5 acting as the common mount means, the intermediate blade member elements 2*a* to 2*c* each are provided with the engagement groove 21 acting as the common mount means, and the upper blade member elements 3*a* to 3*c* each are provided with the holding element 23 acting as the common mount means. Thus, arrangement of such a common mount means on the base blade member elements 1*a* to 1*c* permits the base blade member elements to be replaceable with each other and selectively and detachably mounted with respect to the remaining blade member elements or the intermediate blade member elements and upper blade member elements. This is true of the intermediate blade member elements 2*a* to 2*c* and upper blade member elements 3*a* to 3*c*. This permits a wide variety of toy tops to be provided due to any combination among the base blade member elements, intermediate blade member elements and upper blade member elements.

Thus, for example, for a game or play in which a time length of revolution of the toy top is regarded important, the replacement may be carried out to ensure an increase in centrifugal force of the toy top, stable revolution thereof, a reduction in rotational resistance thereof and the like. Also, for a battle game or play wherein plural such toy tops are struck against each other, the replacement may be carried out so as to increase movability of the toy top, striking power thereof, sustaining power thereof and the like.

As can be seen from the foregoing, one embodiment of the toy tops of the present invention is so constructed that the revolving shaft control mechanism controls revolution of the revolving shaft rotatably mounted on the toy body. Such construction permits a manner of revolution of the toy top to be varied depending on a revolving speed thereof, to thereby provide funny play.

Also, in the embodiment, the revolving shaft control mechanism may be constituted by the press members arranged on the side surface of the revolving shaft so as to be opposite to each other, wherein the press members are arranged in a manner to be movable in the direction perpendicular to the revolving shaft and constantly elastically urged in the direction apart from the revolving shaft, resulting in centrifugal force due to revolution of the toy top pressing the side surface of the revolving shaft against elastic urging by the pressing members. Such configuration of the embodiment permits the toy top to be increased in revolving speed at an initial stage of the revolution, to thereby exert centrifugal force on the press members, so that the press members may forcedly press the revolving shaft against elastic force of the springs, resulting in the revolving shaft being rotated with the toy body. Then, when the revolving shaft is reduced in revolving speed with time, the above-described configuration permits elastic force of the spring of each of the press members to overcome the centrifugal force, so that the revolving shaft may be released from the press members, resulting in the revolving shaft revolving independently from the toy body. This permits the toy top to keep on revolving and the revolving shaft to be kept from revolving.

Further, the present invention may be so constructed that the revolving shaft has the lower end flatly formed. This permits the revolving shaft to revolve together with the toy body at an initial stage of the revolution. Thus, when a game board on which the toy top revolves is formed into a concave shape, a position on the game board at which the revolving shaft is contacted with the game board is substantially varied with time, resulting in gravity of the toy top being varied correspondingly, so that the toy top may continue to revolve while shifting in all directions. Then, when a revolving speed of the revolving shaft is reduced with time, the revolving shaft revolves independently from the toy body, to thereby keep a position of contact between the revolving shaft and the game board from being varied. This keeps a position of gravity of the toy top constant, so that it may revolve at a fixed position.

In addition, the toy top of the present invention may be constituted by the plural blade members mounted on each other. This ensures an increase in centrifugal force of the toy top, stable revolution thereof, a reduction in rotational resistance thereof and the like. In this instance, the revolving shaft control mechanism may be arranged on the lowermost blade member of the blade members arranged in a overlapped manner, therefore, a variation in combination of the blade members may be carried out with respect to the intermediate and upper blade members.

Moreover, at least one of the blade members may be constituted by a weight member. This permits the toy top to exhibit increased revolving characteristics.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A toy top comprising:

a toy body having a revolving shaft which revolves relative to a support surface arranged at a lowermost portion of said toy body and a mount support member provided on said toy body and extending upward from an upper portion of said toy body, said toy top further including a plurality of removable blade members;

said blade members being removably mounted to overlap each other; and said blade members being detachably mounted with respect to a remaining blade member and extending around said mount support member.

2. A toy top as defined in claim 1, wherein said toy body is provided with a revolving shaft control mechanism therein so as to control revolution of said revolving shaft.

3. A toy top as defined in claim 2, wherein said revolving shaft control mechanism further includes a pair of press members arranged on a side surface of said revolving shaft so as to be opposite to each other;

said press members being arranged in a manner to be movable in a direction perpendicular to said revolving shaft and constantly elastically urged in a direction apart from said revolving shaft, resulting in centrifugal force due to revolution of the toy top forcing said side surface of said revolving shaft against elastic urging of said pressing members.

4. A toy top as defined in claim 2, wherein said revolving shaft has a lower end flatly formed.

5. A toy top as defined in claim 2, wherein said revolving shaft control mechanism is arranged on a lowermost blade member of said blade members.

6. A toy top as defined in claim 5, wherein at least one of said blade members is constituted by a weight member.

7. A re-configurable toy top comprising:

a base member with a shaft extending below for rotational contact with a support surface;

a mount support member is removably connected to the base member to extend upward;

at least one first removable stopper member can be mounted into the base member to releasably lock the mount support member to the base member;

an intermediate weight member is removable mounted to extend radially outward from the mount support member; and an upper member is removably interconnected with the mount support member to complete the toy top whereby the removable members can be replaced to reconfigure the toy top for varying certain performance characteristics of the toy top.

8. The reconfigurable toy top of claim 7, further including a second removable stopper member removably mounted into the base member at a position 180° from the first removable stopper member to releasably lock the mount support member.

9. The reconfigurable toy top of claim 7 wherein one of the mount support members and the upper member has at least a holding element and the other has a cutout portion for receiving the holding element wherein relative rotation of the mount support member and the upper member after the holding element is operatively positioned in the cutout portion provides a releasable locking of the upper member to the mount support member.

10. The reconfigurable toy top of claim 7 wherein one of the mount support member and the intermediate weight member has an engagement groove and the other has a projection for operative engagement with the engagement groove to prevent relative rotation.

11. A re-configurable toy top comprising:

a base member with a shaft extending below for rotational contact with a support surface;

a mount support member is removably connected to the base member to extend upward;

an intermediate weight member is removable mounted to extend radially outward from the mount support member; and an upper member is removably interconnected with the mount support member to complete the toy top whereby the removable members can be replaced to reconfigure the toy top for varying certain performance characteristics of the toy top.

12. The reconfigurable toy top of claim 11 wherein one of the mount support members and the upper member has at least a holding element and the other has a cutout portion for receiving the holding element wherein relative rotation of the mount support member and the upper member after the holding element is operatively positioned in the cutout portion provides a releasable locking of the upper member to the mount support member.

13. The reconfigurable toy top of claim 12 wherein one of the mount support members and the upper member has at least a holding element and the other has a cutout portion for receiving the holding element wherein relative rotation of the mount support member and the upper member after the holding element is operatively positioned in the cutout portion provides a releasable locking of the upper member to the mount support member.

14. The reconfigurable toy top of claim 11 wherein the upper member has a radially protruding operation element for striking a competing toy top.

* * * * *